US009827791B2

(12) United States Patent
Shinohara et al.

(10) Patent No.: US 9,827,791 B2
(45) Date of Patent: Nov. 28, 2017

(54) PRINTER WITH LOWER CONVEYER

(71) Applicant: RISO KAGAKU CORPORATION, Tokyo (JP)

(72) Inventors: Masaaki Shinohara, Ibaraki (JP); Masashi Hara, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/438,810

(22) Filed: Feb. 22, 2017

(65) Prior Publication Data

US 2017/0253053 A1 Sep. 7, 2017

(30) Foreign Application Priority Data

Mar. 1, 2016 (JP) ..... 2016-038931

(51) Int. Cl.

| | |
|---|---|
| ***B41J 29/38*** | (2006.01) |
| ***B41J 11/00*** | (2006.01) |
| ***B41J 2/01*** | (2006.01) |
| ***B41J 3/60*** | (2006.01) |
| ***B41J 13/00*** | (2006.01) |

(52) U.S. Cl.

CPC ..... *B41J 11/006* (2013.01); *B41J 2/01* (2013.01); *B41J 3/60* (2013.01); *B41J 11/007* (2013.01); *B41J 13/0054* (2013.01)

(58) Field of Classification Search

None

See application file for complete search history.

(56) References Cited

U.S. PATENT DOCUMENTS

| | | | | |
|---|---|---|---|---|
| 2010/0013877 | A1* | 1/2010 | Haraguchi | B41J 11/007 347/8 |
| 2015/0266314 | A1* | 9/2015 | Toia | B41J 11/006 347/104 |
| 2016/0275389 | A1 | 9/2016 | Hara | |

FOREIGN PATENT DOCUMENTS

| | | |
|---|---|---|
| JP | 2013-151068 | 8/2013 |

* cited by examiner

*Primary Examiner* — Erica Lin

(74) *Attorney, Agent, or Firm* — Greenblum & Bernstein, P.L.C.

(57) ABSTRACT

A controller, upon remaining sheets existing in both a print conveyer and a lower conveyer and a sheet size of the sheets being equal to or larger than a specified size upon occurrence of a sheet jam: control an elevator to maintain the print conveyer at a print position, determine to position the print conveyer at a lower limit position in response to removal of the remaining sheet from the lower conveyer, and then drive the elevator to move the print conveyer to the lower limit position; or drive the elevator to move the print conveyer to the lower limit position, determine to position the print conveyer at the print position in response to removal of the remaining sheet from the lower conveyer, and then drive the elevator to move the print conveyer to the print position.

1 Claim, 5 Drawing Sheets

PRINTER WITH LOWER CONVEYER

CROSS REFERENCE TO RELATED APPLICATION

This application is based upon and claims the benefit of priority from the prior Japanese Patent Application No. 2016-038931, filed on Mar. 1, 2016, the entire contents of which are incorporated herein by reference.

BACKGROUND

1. Technical Field

The disclosure relates to a printer which performs printing on sheets.

2. Related Art

Japanese Unexamined Patent Application Publication No. 2013-151068 describes a printer which performs printing by ejecting inks from inkjet heads while conveying sheets by using a belt platen.

In this printer, when a sheet jam occurs, the belt platen is lowered to remove a remaining sheet on the belt platen. A work space for a user to remove the remaining sheet is thereby formed between the inkjet head and the belt platen.

SUMMARY

In some of printers like one described above, a conveyance route for turning over and refeeding a sheet printed on one side in duplex printing is arranged below the belt platen. In such printers, when the belt platen is lowered in the occurrence of a sheet jam, there is no work space for the user to remove the remaining sheet on the conveyance route below the belt platen and the workability is poor in some cases. Accordingly, the usability for jam removal is not good enough.

An object of the disclosure is to provide a printer with improved usability in jam removal.

A printer in accordance with some embodiments includes: a print conveyer configured to convey a sheet during image formation; an elevator configured to lift up and down the print conveyer to any of a print position for performing image formation, a lower limit position lower than the print position, and an intermediate position between the print position and the lower limit position; a sheet feeder configured to feed the sheet to the print conveyer; a sheet discharger configured to receive the sheet from the print conveyer and discharge the sheet; a duplex printing conveyer including a lower conveyer configured to convey the sheet below the print conveyer, the duplex printing conveyer being configured to convey the sheet printed on one side from a downstream end to an upstream end of the print conveyer in duplex printing; and a controller configured to control the elevator. The controller is configured to, upon no remaining sheet existing in the lower conveyer upon occurrence of a sheet jam, determine to position the print conveyer at the lower limit position for jam removal and then drive the elevator to move the print conveyer to the lower limit position. The controller is configured to, upon a remaining sheet existing in the lower conveyer and no remaining sheet existing in the print conveyer upon occurrence of the sheet jam, determine to position the print conveyer at the print position for jam removal and then control the elevator to maintain the print conveyer at the print position. The controller is configured to, upon remaining sheets existing in both the print conveyer and the lower conveyer and a sheet size of the sheets being smaller than a specified size upon occurrence of the sheet jam, determine to position the print conveyer at the intermediate position for jam removal and then drive the elevator to move the print conveyer to the intermediate position. The controller is configured to, upon remaining sheets existing in both the print conveyer and the lower conveyer and the sheet size of the sheets being equal to or larger than the specified size upon occurrence of the sheet jam: determine to position the print conveyer at the print position for jam removal, control the elevator to maintain the print conveyer at the print position, determine to position the print conveyer at the lower limit position in response to removal of the remaining sheet from the lower conveyer, and then drive the elevator to move the print conveyer from the print position to the lower limit position; or determine to position the print conveyer at the lower limit position for jam removal, drive the elevator to move the print conveyer from the print position to the lower limit position, determine to position the print conveyer at the print position in response to removal of the remaining sheet from the lower conveyer, and then drive the elevator to move the print conveyer from the lower limit position to the print position.

In the configuration described above, when no remaining sheet exists in the lower conveyer upon occurrence of a sheet jam, the controller determines to position the print conveyer at the lower limit position for jam removal. A work space for removing the remaining sheet from the print conveyer is thereby formed. Meanwhile, when the remaining sheet exists in the lower conveyer and no remaining sheet exists in the print conveyer, the controller determines to position the print conveyer at the print position for jam removal. A work space for removing the remaining sheet from the lower conveyer is thereby formed.

Moreover, when the remaining sheets exist in both of the print conveyer and the lower conveyer and the sheet size is smaller than the specified size, the controller determines to position the print conveyer at the intermediate position for jam removal. The work spaces for removing the remaining sheets from the print conveyer and the lower conveyer are thereby formed without moving the print conveyer in the middle of jam removal work when the size of the remaining sheet is so small that only a relatively small work space is required to remove the remaining sheet from the print conveyer.

Furthermore, when the remaining sheets exist in both of the print conveyer and the lower conveyer and the sheet size is the specified size or larger, the controller determines to initially position the print conveyer at the print position for jam removal, and changes the position of the print conveyer to the lower limit position after the remaining sheet is removed from the lower conveyer. Alternatively, the controller determines to initially position the print conveyer at the lower limit position for jam removal, and changes the position of the print conveyer to the print position after the remaining sheet is removed from the print conveyer. The work space for removing the remaining sheets from the print conveyer and the lower conveyer are thereby formed when the size of the remaining sheet is so large that a relatively large work space is required to remove the remaining sheet from the print conveyer.

Hence, in the configuration described above, it is possible to form the work spaces for removing the remaining sheets from the print conveyer and the lower conveyer while reducing the frequency of moving the print conveyer in the middle of jam removal work. As a result, the usability for jam removal can be improved.

DETAILED DESCRIPTION

Figure 1:
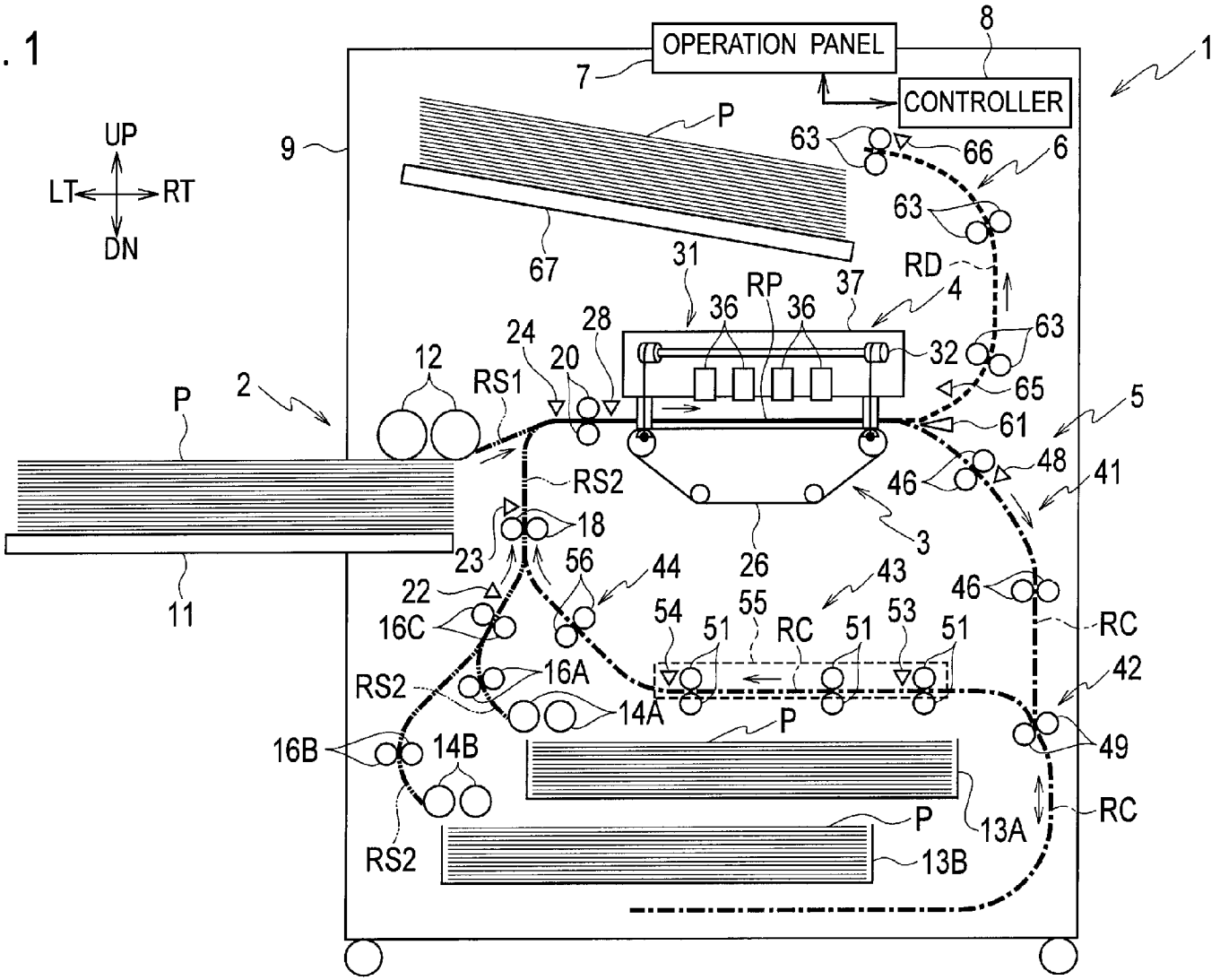
FIG. 1 is a schematic configuration diagram of a printer according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
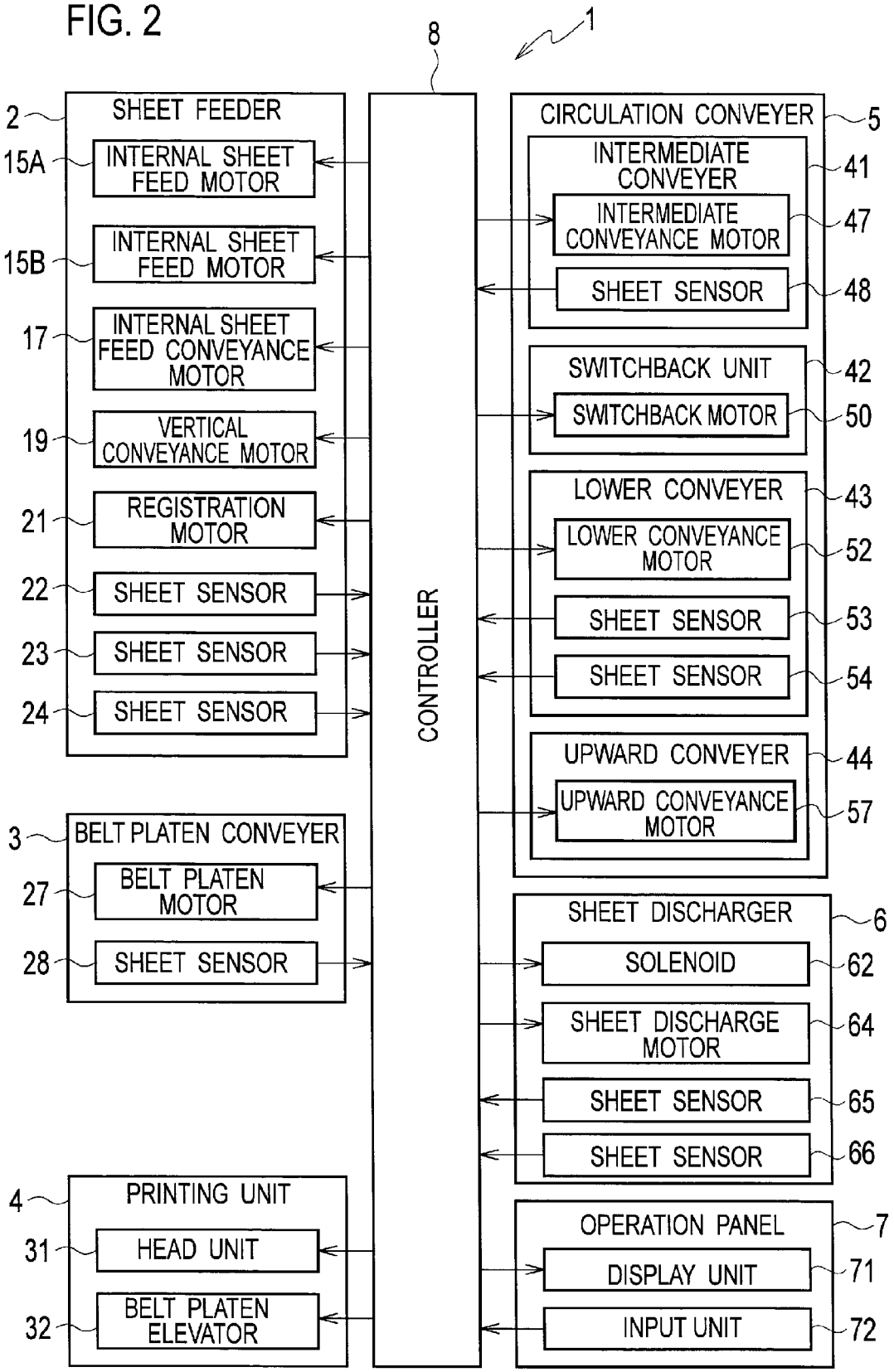
FIG. 2 is a control block diagram of the printer illustrated in FIG. 1.

FIG. 1 is a schematic configuration diagram of a printer according to an embodiment of the present invention. FIG. 2 is a control block diagram of the printer 1 illustrated in FIG. 1. In the following description, a direction orthogonal to a sheet plane of FIG. 1 is a front-rear direction and a sheet surface of FIG. 1 facing a viewer is a front side. Moreover, in FIG. 1, a rightward direction, a leftward direction, an upward direction, and a downward direction are denoted by RT, LT, UP, and DN, respectively.

A route illustrated by bold lines in FIG. 1 is a conveyance route through which sheets being print media are conveyed. In the conveyance route, a route illustrated by a solid line is a print route RP, a route illustrated by one-dot chain lines is a circulation route RC, a route illustrated by a broken line is a sheet discharge route RD, and routes illustrated by two-dot chain lines are an external sheet feed route RS1 and an internal sheet feed route RS2. In the following description, upstream and downstream mean upstream and downstream in the conveyance route.

As illustrated in FIGS. 1 and 2, the printer 1 of the embodiment includes a sheet feeder 2, a belt platen conveyer 3, a printing unit 4, a circulation conveyer 5, a sheet discharger 6, an operation panel 7, a controller 8, and a case 9 configured to house or hold the aforementioned units.

The sheet feeder 2 feeds unprinted sheets P to the belt platen conveyer 3. Moreover, the sheet feeder 2 refeeds the sheets P printed on one sides to the belt platen conveyer 3 in duplex printing. The sheet feeder 2 is arranged upstream of all the other units in the conveyance route. The sheet feeder 2 includes an external sheet feed tray 11, external sheet feed rollers 12, internal sheet feed trays 13A and 13B, internal sheet feed rollers 14A and 14B, internal sheet feed motors 15A and 15B, internal sheet feed conveyance rollers 16A to 16C, an internal sheet feed conveyance motor 17, vertical conveyance rollers 18, a vertical conveyance motor 19, registration rollers 20, a registration motor 21, and sheet sensors 22 to 24.

The external sheet feed tray 11 is a tray on which the sheets P used for printing are stacked. The external sheet feed tray 11 is installed to be partially exposed to the outside of the case 9.

The external sheet feed rollers 12 pick up the sheets P stacked on the external sheet feed tray 11 one by one, and convey the sheets P along the external sheet feed route RS1 toward registration rollers 20.

The internal sheet feed trays 13A and 13B are trays on which the sheets P used for printing are stacked. The internal sheet feed trays 13A and 13B are arranged inside the case 9.

The pairs of internal sheet feed rollers 14A and 14B each pick up the sheets P stacked on a corresponding one of the internal sheet feed trays 13A and 13B one by one.

The internal sheet feed motors 15A and 15B rotationally drive the pairs of internal sheet feed rollers 14A and 14B, respectively.

The internal sheet feed conveyance rollers 16A and 16B convey the sheets P picked up from the internal sheet feed trays 13A and 13B by the internal sheet feed rollers 14A and 14B, to the internal sheet feed conveyance rollers 16C. The internal sheet feed conveyance rollers 16C convey the sheets P conveyed by the internal sheet feed conveyance rollers 16A or the internal sheet feed conveyance rollers 16B, to the vertical conveyance rollers 18. The internal sheet feed conveyance rollers 16C are arranged downstream of a point where a portion of the internal sheet feed route RS2 extending from the internal sheet feed rollers 14A and a portion of the internal sheet feed route RS2 extending from the internal sheet feed rollers 14B merge.

The internal sheet feed conveyance motor 17 rotationally drives the internal sheet feed conveyance rollers 16A to 16C.

The vertical conveyance rollers 18 convey the sheets P conveyed from the internal sheet feed conveyance rollers 16C along the internal sheet feed route RS2, to the registration rollers 20. Moreover, in the duplex printing, the vertical conveyance rollers 18 convey the sheets P printed on one sides and conveyed and circulated along the circulation route RC, to the registration rollers 20. The vertical conveyance rollers 18 are arranged in the internal sheet feed route RS2, downstream of a point where the circulation route RC merges with the internal sheet feed route RS2.

The vertical conveyance motor 19 rotationally drives the vertical conveyance rollers 18. Moreover, the vertical conveyance motor 19 rotationally drives the external sheet feed rollers 12. The vertical conveyance motor 19 is connected to each of the pair of the vertical conveyance rollers 18 and the pair of the external sheet feed rollers 12 via a not-illustrated one-way clutch. Thus, the vertical conveyance rollers 18 are rotationally driven by rotation drive of the vertical conveyance motor 19 in one direction, whereas the external sheet feed rollers 12 are rotationally driven by rotation drive of the vertical conveyance motor 19 in the other direction.

The registration rollers 20 temporarily stop each of the sheets P conveyed by the external sheet feed rollers 12 or the vertical conveyance rollers 18 to correct skew of the sheet P and then convey the sheet P toward a belt platen 26 to be described later. The registration rollers 20 are arranged in the print route RP near and downstream of a point where the external sheet feed route RS1 and the internal sheet feed route RS2 merge.

The registration motor 21 rotationally drives the registration rollers 20.

The sheet sensor 22 detects the sheets P picked up from the internal sheet feed trays 13A and 13B and conveyed to the vertical conveyance rollers 18. The sheet sensor 22 is arranged near and downstream of the internal sheet feed conveyance rollers 16C.

The sheet sensor 23 detects the sheets P conveyed from the vertical conveyance rollers 18 to the registration rollers 20. The sheet sensor 23 is arranged near and downstream of the vertical conveyance rollers 18.

The sheet sensor 24 detects the sheets P entering the registration rollers 20 by being conveyed by the external sheet feed rollers 12 or the vertical conveyance rollers 18. The sheet sensor 24 is arranged near and upstream of the registration rollers 20.

The belt platen conveyer 3 conveys the sheets P conveyed from the sheet feeder 2 to the circulation conveyer 5 or the sheet discharger 6. The belt platen conveyer 3 is arranged downstream of the sheet feeder 2. The belt platen conveyer 3 includes the belt platen (print conveyer) 26, a belt platen motor 27, and a sheet sensor 28.

The belt platen 26 conveys each of the sheets P conveyed by the registration rollers 20 by sucking and holding the sheet P on a belt. Inks are ejected from inkjet heads 36 to be described later while the sheet P is conveyed by the belt platen 26 and an image is thereby printed (formed) on the sheet P. In other words, the belt platen 26 conveys the sheet P in printing (image formation). The belt platen 26 is arranged downstream of the registration rollers 20.

Figure 3:
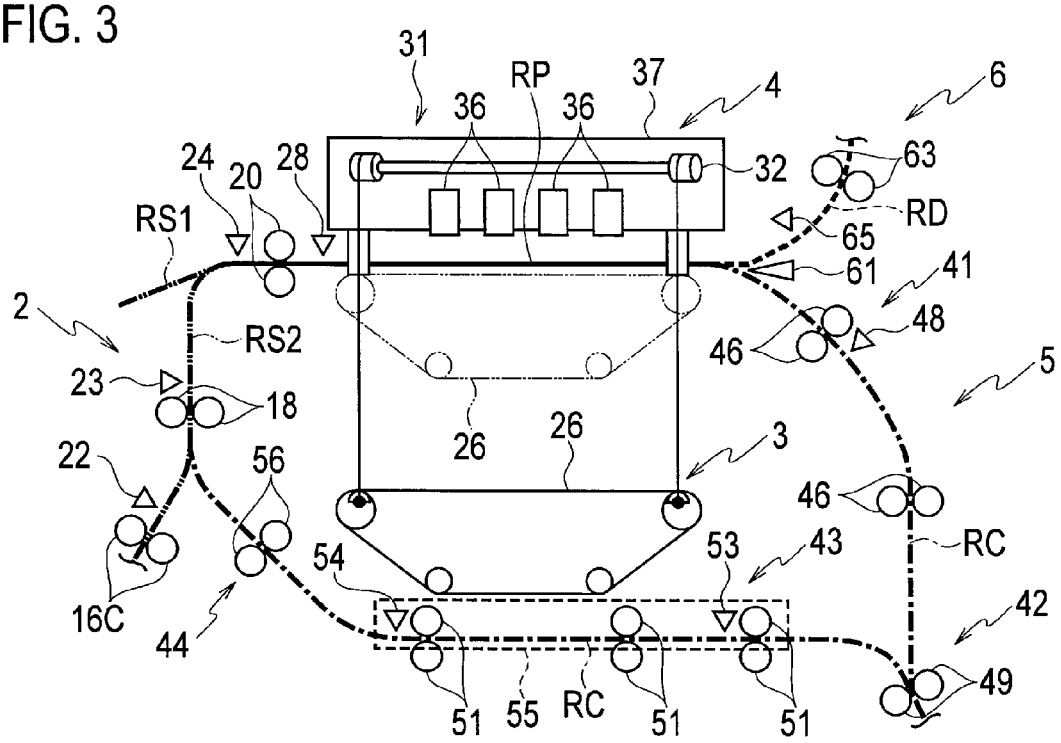
FIG. 3 is a diagram for explaining a lower limit position of a belt platen.
Figure 4:
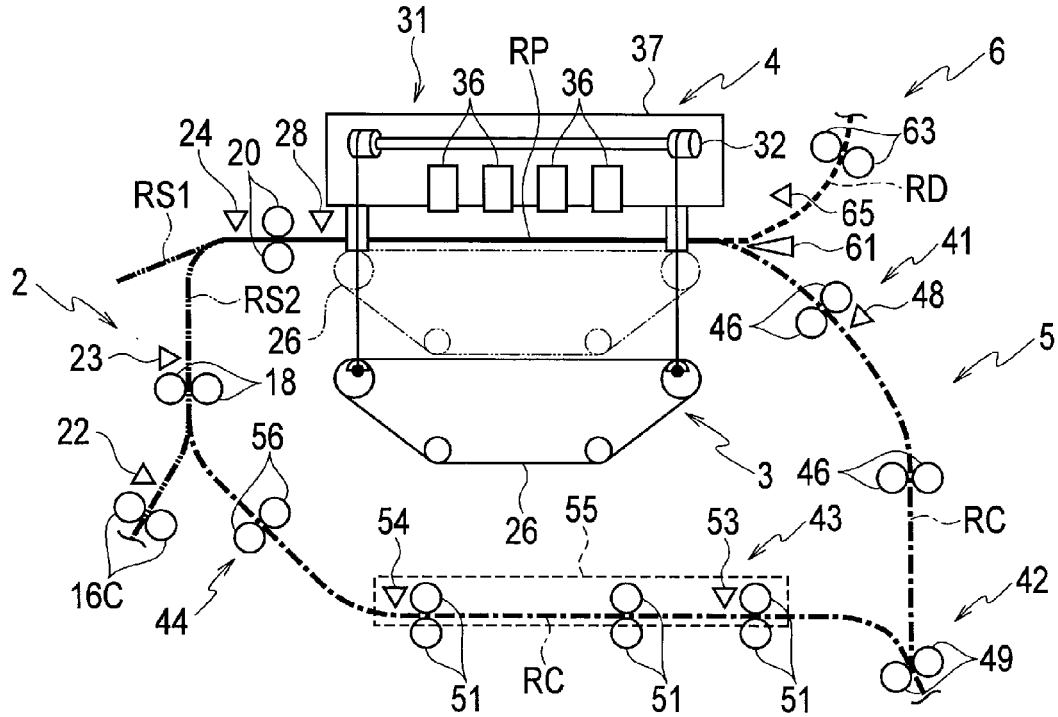
FIG. 4 is a diagram for explaining an intermediate position of the belt platen.

The belt platen 26 is capable of being moved up and down to be set at any of a print position, a lower limit position, and an intermediate position by a belt platen elevator 32 to be described later. The print position is the position of the belt platen 26 during printing (during image formation) by the printing unit 4. The print position is the position of the belt platen 26 illustrated in FIG. 1 and is below and near the inkjet heads 36. The lower limit position is the position of the belt platen 26 illustrated by solid lines in FIG. 3 and is a position where the belt platen 26 is lowered to the maximum possible extent. The lower limit position is lower than the print position and is above and near lower conveyance rollers 51 to be described later. The intermediate position is the position of the belt platen 26 illustrated by solid lines in FIG. 4 and is between the print position and the lower limit position.

The belt platen motor 27 drives the belt of the belt platen 26.

The sheet sensor 28 detects the sheets P conveyed from the registration rollers 20 to the belt platen 26. The sheet sensor 28 is arranged between the pair of registration rollers 20 and an upstream end of the belt platen 26.

The printing unit 4 performs printing on the sheets P. The printing unit 4 is arranged above the belt platen 26. The printing unit 4 includes a head unit 31 and the belt platen elevator 32 (elevator).

The head unit 31 prints an image by ejecting the inks to each sheet P conveyed by the belt platen 26. The head unit 31 includes multiple inkjet heads 36 and a head holder 37.

Each of the inkjet heads 36 has multiple nozzles aligned in the front-rear direction (main scanning direction) and ejects the ink from the nozzles. The multiple inkjet heads 36 are aligned in the conveying direction of the sheets P (left-right direction) to be parallel to each other.

The head holder 37 holds the inkjet heads 36. The head holder 37 is fixed at a predetermined position in the case 9.

The belt platen elevator 32 lifts up and down the belt platen 26 to the print position, the lower limit position, and the intermediate position. The belt platen elevator 32 is arranged in the head holder 37. The belt platen elevator 32 includes wires, pulleys, a motor, and the like and supports the belt platen 26 in a suspended manner by using the wires. The belt platen elevator 32 lifts up and down the belt platen 26 by rotating the pulleys with the motor to let out and take up the wires.

The circulation conveyer 5 conveys the sheets P printed on one sides along the circulation route RC from a downstream end of the belt platen 26 to the vertical conveyance rollers 18, in the duplex printing. The sheets P printed on one sides and conveyed from the circulation conveyer 5 to the vertical conveyance rollers 18 are conveyed to the belt platen 26 by the vertical conveyance rollers 18 and the registration rollers 20. Specifically, in the duplex printing, the circulation conveyer 5, the vertical conveyance rollers 18, and the registration rollers 20 convey the sheets P printed on one sides from the downstream end to the upstream end of the belt platen 26. The circulation conveyer 5, the vertical conveyance rollers 18, and the registration rollers 20 form a duplex printing conveyer.

The circulation conveyer 5 includes an intermediate conveyer 41, a switchback unit 42, a lower conveyer 43, and an upward conveyer 44.

The intermediate conveyer 41 conveys the sheets P printed on one sides from the belt platen 26 to the switchback unit 42 in duplex printing. The intermediate conveyer 41 includes two pairs of intermediate conveyance rollers 46, an intermediate conveyance motor 47, and a sheet sensor 48.

The intermediate conveyance rollers 46 receive the sheets P printed on one sides and sent out from the belt platen 26 and convey the sheets P to switchback rollers 49 to be described later. The two pairs of intermediate conveyance rollers 46 are arranged along the circulation route RC between the belt platen 26 and the switchback rollers 49.

The intermediate conveyance motor 47 rotationally drives the two pairs of intermediate conveyance rollers 46. Moreover, the intermediate conveyance motor 47 rotationally drives two pairs of sheet discharge rollers 63 to be described later.

The sheet sensor 48 detects the sheets P conveyed by the intermediate conveyance rollers 46 to the switchback rollers 49. The sheet sensor 48 is arranged near and downstream of the upstream pair of the intermediate conveyance rollers 46.

The switchback unit 42 turns over the sheets P printed on one sides. The switchback unit 42 includes the switchback rollers 49 and a switchback motor 50.

The switchback rollers 49 turn over the sheets P conveyed by the intermediate conveyance rollers 46, by switching back the sheets P. The switchback rollers 49 are arranged downstream of the intermediate conveyance rollers 46 in the circulation route RC.

The switchback motor 50 rotationally drives the switchback rollers 49.

The lower conveyer 43 conveys the sheets P from the switchback unit 42 to the upward conveyer 44. The lower conveyer 43 is arranged below the belt platen 26. The lower conveyer 43 includes three pairs of lower conveyance rollers 51, a lower conveyance motor 52, sheet sensors 53 and 54, and a lower jam removal mechanism 55.

The lower conveyance rollers 51 convey the sheets P switched back by the switchback rollers 49 to upward conveyance rollers 56. The three pairs of lower conveyance rollers 51 are arranged in a horizontal portion of the circulation route RC below the belt platen 26.

The lower conveyance motor 52 rotationally drives the two pairs of lower conveyance rollers 51 on the upstream side. Note that the most downstream pair of lower conveyance rollers 51 is rotationally driven by an upward conveyance motor 57 to be described later.

The sheet sensors 53 and 54 detect the sheets P switchback by the switchback rollers 49 and then conveyed to the vertical conveyance rollers 18 along the circulation route RC. The sheet sensor 53 is arranged near and downstream of the most upstream pair of lower conveyance rollers 51. The sheet sensor 54 is arranged near and downstream of the most downstream pair of lower conveyance rollers 51.

The lower jam removal mechanism 55 is a mechanism for pulling out an upper guide plate (not illustrated) of the circulation route RC and the lower conveyance roller 51 on the upper side in each of the three pairs of lower conveyance rollers 51, toward the front side. When a jam occurs, a user can remove a sheet remaining in the lower conveyer 43 by manually operating the lower jam removal mechanism 55 and pulling out the guide plate and the lower conveyance rollers 51 on the upper side toward the user.

Note that a mechanism (not illustrated) other than the lower jam removal mechanism 55 which enables the user to remove the remaining sheet in the occurrence of a jam is provided in the printer 1 at an appropriate portion.

The upward conveyer 44 conveys the sheets P from the lower conveyer 43 to the vertical conveyance rollers 18. The upward conveyer 44 includes the upward conveyance rollers 56 and the upward conveyance motor 57.

The upward conveyance rollers 56 convey the sheets P conveyed from the lower conveyance rollers 51 to the vertical conveyance rollers 18. The upward conveyance rollers 56 are arranged in an upward conveying portion between a downstream end of the horizontal portion of the circulation route RC in which the lower conveyance rollers 51 are arranged and a point where the circulation route RC merges with the internal sheet feed route RS2.

The upward conveyance motor 57 rotationally drives the upward conveyance rollers 56 and the most downstream pair of lower conveyance rollers 51.

The sheet discharger 6 discharges the printed sheets P. The sheet discharger 6 includes a switching unit 61, a solenoid 62, three pairs of sheet discharge rollers 63, a sheet discharge motor 64, sheet sensors 65 and 66, and a sheet receiving tray 67.

The switching unit 61 switches the conveyance route of the sheets P from the sheet discharge route RD to the circulation route RC and vice versa. The switching unit 61 is arranged at a branching point between the sheet discharge route RD and the circulation route RC.

The solenoid 62 drives the switching unit 61.

The sheet discharge rollers 63 receive the sheets P conveyed from the belt platen 26 and discharge the sheet P to the sheet receiving tray 67. The sheet discharge rollers 63 are arranged along the sheet discharge route RD.

The sheet discharge motor 64 rotationally drives the most downstream pair of sheet discharge rollers 63. Note that the two pairs of sheet discharge rollers 63 on the upstream side are rotationally driven by the intermediate conveyance motor 47.

The sheet sensors 65 and 66 detect the sheets P conveyed along the sheet discharge route RD. The sheet receiving tray 67 is arranged between the switching unit 61 and the most upstream pair of sheet discharge rollers 63. The sheet sensor 66 is arranged near and upstream of the most downstream pair of sheet discharge rollers 63.

The sheet receiving tray 67 is a tray on which the sheets P discharged by the sheet discharge rollers 63 are stacked. The sheet receiving tray 67 is arranged at a downstream end of the sheet discharge route RD.

The operation panel 7 displays various input screens and the like and receives input operations by the user. The operation panel 7 includes a display unit 71 and an input unit 72.

The display unit 71 displays the various input screens and the like. The display unit 71 includes a liquid crystal display panel and the like.

The input unit 72 receives the input operations by the user and outputs operation signals according to the operations. The input unit 72 includes various operation keys, a touch panel, and the like.

The controller 8 controls operations of the units in the printer 1. The controller 8 includes a CPU, a RAM, a ROM, a hard disk, and the like.

Specifically, the controller 8 performs control such that the sheets P are fed to the belt platen 26 by the sheet feeder 2 and is subjected to printing by using the inks ejected from the inkjet heads 36 while being conveyed by the belt platen 26. In the duplex printing, the controller 8 performs control such that the sheets P printed on one sides are turned over by the circulation conveyer 5, conveyed to the vertical conveyance rollers 18 of the sheet feeder 2, refed to the belt platen 26 by the vertical conveyance rollers 18 and the registration rollers 20, and subjected to printing on an unprinted side. The controller 8 performs control such that the printed sheets P are discharged by the sheet discharger 6.

Upon occurrence of a sheet jam in the print operation, the controller 8 determines which position to dispose the belt platen 26 for jam removal. Then, the controller 8 controls the belt platen elevator 32 such that the belt platen 26 is arranged at the determined position.

Specifically, when no remaining sheet exists in the lower conveyer 43 upon occurrence of a sheet jam, the controller 8 determines to position the belt platen 26 at the lower limit position for the jam removal. When a remaining sheet exists in the lower conveyer 43 and no remaining sheet exists in the belt platen 26, the controller 8 determines to position the belt platen 26 at the print position for the jam removal. When remaining sheets exist in both of the belt platen 26 and the lower conveyer 43 and the sheet size is smaller than a specified size, the controller 8 determines to position the belt platen 26 at the intermediate position for the jam removal. When remaining sheets exist in both of the belt platen 26 and the lower conveyer 43 and their sheet size is the specified size or larger, the controller 8 determines to initially position the belt platen 26 at the lower limit position for the jam removal and, after the remaining sheet is removed from the belt platen 26, changes the position of the belt platen 26 to the print position.

Next, operations of the printer 1 are described.

Figure 5:
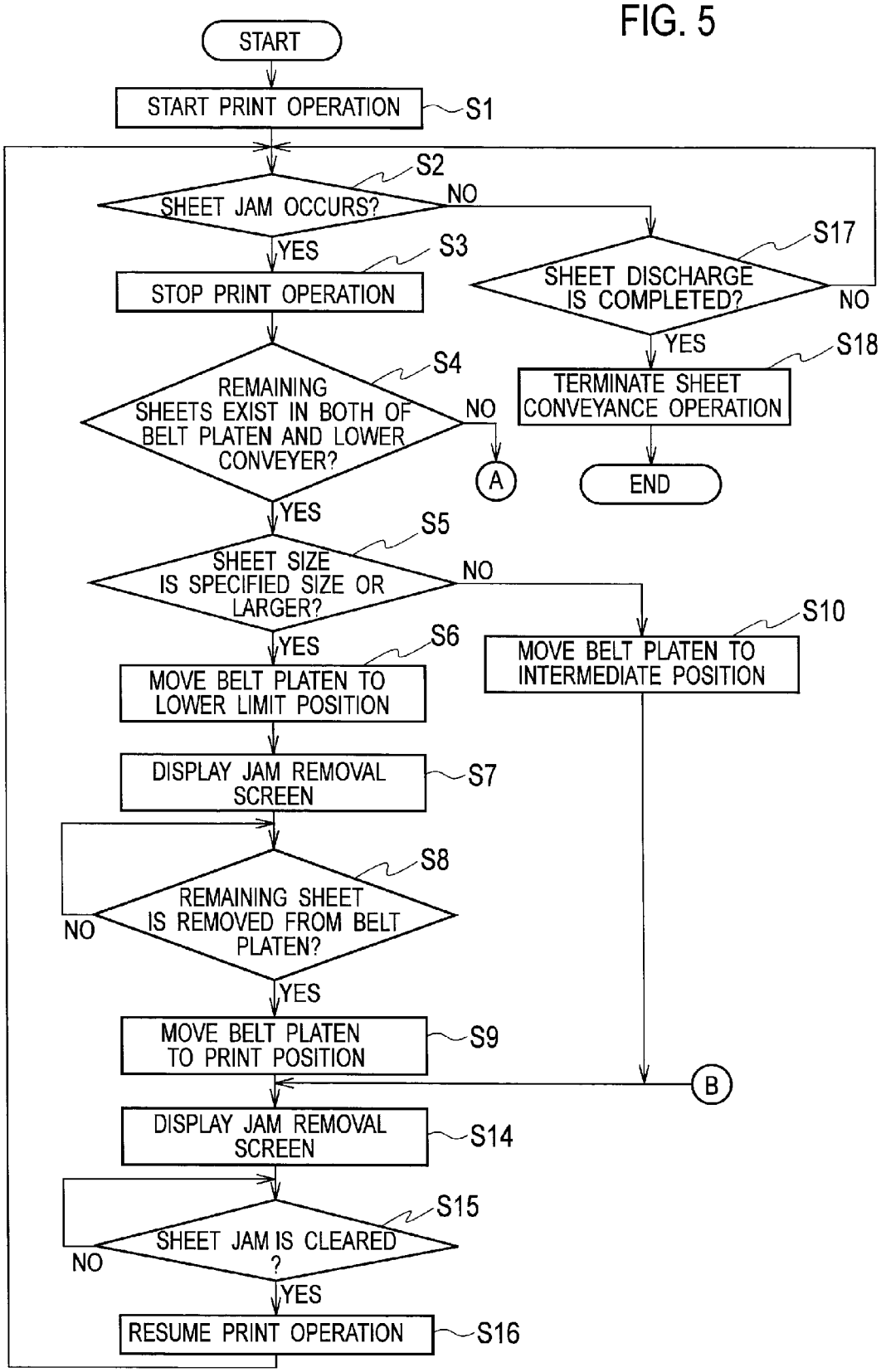
FIG. 5 is a flowchart for explaining operations of the printer illustrated in FIG. 1.
Figure 6:
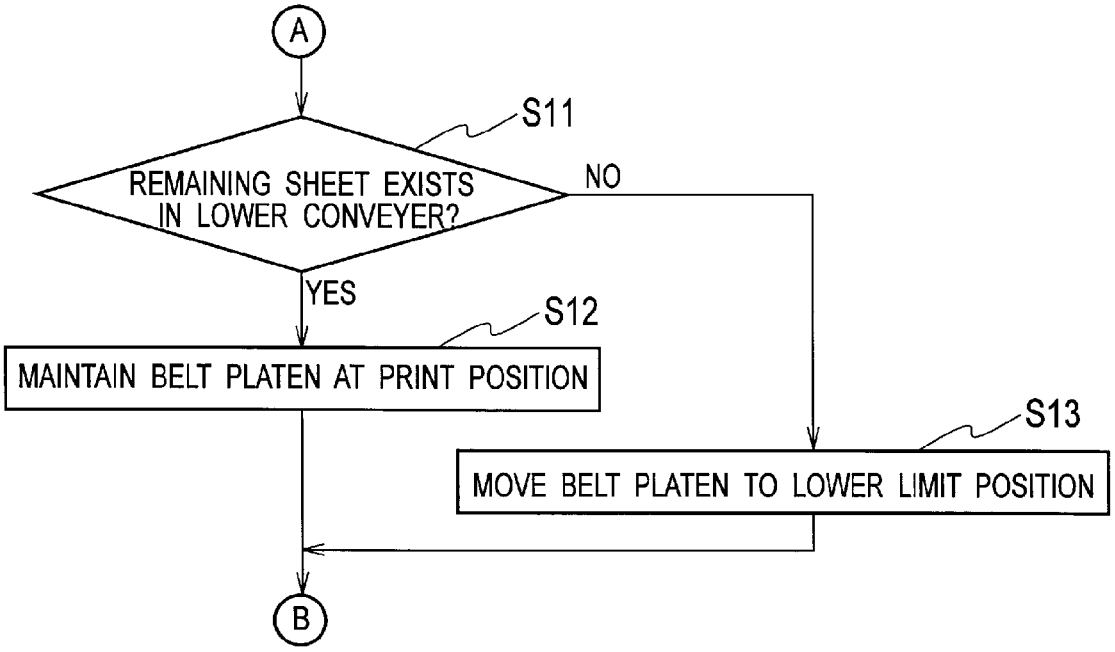
FIG. 6 is a flowchart for explaining operations of the printer illustrated in FIG. 1.

FIGS. 5 and 6 are flowcharts for explaining the operations of the printer 1. The processing of the flowcharts of FIGS. 5 and 6 starts when a print job is inputted into the printer 1.

In step S1 of FIG. 5, the controller 8 starts the print operation. In this case, the controller 8 obtains simplex/duplex print setting information included in the print job and executes the simplex printing or the duplex printing depending on the contents of this information.

In the case of simplex print setting, the controller 8 controls the sheet feeder 2 such that the unprinted sheets P are picked up from one of the external sheet feed tray 11 and the internal sheet feed trays 13A and 13B and are sequentially fed to the belt platen 26. Under the control of the controller 8, the sheet feeder 2 feeds the sheets P sequentially at such timings that the sheets P can be conveyed at predetermined sheet intervals in the belt platen 26. Multiple sheets P are thereby conveyed simultaneously on the conveyance route.

The fed sheets P are subjected to printing by using the inks ejected from the inkjet heads 36 while being conveyed at a predetermined print conveyance speed in the belt platen 26. In this case, the belt platen 26 is arranged at the print position. The printed sheets P are guided to the sheet discharge route RD by the switching unit 61, conveyed by the sheet discharge rollers 63, and discharged to the sheet receiving tray 67.

In the case of duplex print setting, the controller 8 controls the sheet feeder 2 such that the time between the timings at which the unprinted sheets P are fed is twice as that in the simplex printing.

The fed sheets P are subjected to printing while being conveyed by the belt platen 26 arranged at the print position, as in the simplex printing. The sheets P printed on one sides are guided to the circulation route RC by the switching unit 61 and conveyed to the switchback rollers 49 by the intermediate conveyance rollers 46. When the sheets P reach the switchback rollers 49, the sheets P are switched back by the switchback rollers 49. Then, the sheets P printed on one sides are conveyed to the vertical conveyance rollers 18 by the lower conveyance rollers 51 and the upward conveyance rollers 56. Next, the sheets P printed on one sides are refed to the belt platen 26 by the vertical conveyance rollers 18 and the registration rollers 20.

In this case, the sheets P printed on one sides are refed at such timings that the sheets P printed on one sides and the sequentially-fed unprinted sheets P are alternately sent to the belt platen 26. As described above, in the duplex printing, the time between the sheet feed timings of the sheets P is twice as that in the simplex printing. Accordingly, it is possible to insert the sheets P printed on one side between the unprinted sheets P and alternately perform the feeding of the unprinted sheets P and the refeeding of the sheets P printed on one sides.

Since the sheets P printed on one sides are switched back by the switchback rollers 49, the sheets P printed on one sides are sent to the belt platen 26 with the unprinted sides facing upward. The sheets P printed on one sides are subjected to printing on the unprinted sides while being conveyed by the belt platen 26. Then, the sheets P printed on both sides are guided to the sheet discharge route RD by the switching unit 61, are conveyed by the sheet discharge rollers 63, and are discharged to the sheet receiving tray 67.

As described above, in the duplex printing, the feeding of the unprinted sheets P and the refeeding of the sheets P printed on one sides are alternately performed, and the printing on one sides of the unprinted sheets P and the printing on the unprinted sides of the sheets P printed on one sides are thus alternately performed on the belt platen 26. The duplex printing is thereby performed with the productivity for one side being equivalent to that in the simplex printing.

After the start of the simplex printing or the duplex printing as described above, in step S2, the controller 8 determines whether a sheet jam occurs. The controller 8 determines that the sheet jam occurs when detecting abnormality such as the detection timing of each sheet P at any of the sheet sensors 22 to 24, 28, 48, 53, 54, 65, and 66 being late by a threshold or more from a theoretical value.

When the controller 8 determines that the sheet jam occurs (step S2: YES), in step S3, the controller 8 stops the print operation. Specifically, the controller 8 stops the sheet conveyance by the sheet feeder 2, the belt platen conveyer 3, the circulation conveyer 5, and the sheet discharger 6. Moreover, the controller 8 stops the printing by the printing unit 4. In this case, the controller 8 stops the sheet conveyance after discharging the sheet P determined to be dischargeable based on the positional relationship with a position where the sheet jam occurs. For example, in the simplex printing, since the sheet P located downstream of the position where the sheet jam occurs can be discharged, the controller 8 discharges the sheet P located downstream of the position where the sheet jam occurs and then stops the sheet conveyance.

Next, in step S4, the controller 8 determines whether remaining sheets exist in both of the belt platen 26 and the lower conveyer 43.

In this case, the remaining sheets are the sheets P remaining in the conveyance route when the sheet conveyance is stopped in step S3 due to the occurrence of the sheet jam. The controller 8 grasps the positions of the remaining sheets on the conveyance route at the time of the sheet conveyance stop, by using the sheet detection timings at the sheet sensors 22 to 24, 28, 48, 53, 54, 65, and 66 and the numbers of pulses outputted from encoders installed respectively in motors of various units such as the intermediate conveyance motor 47. When the remaining sheet exists at least partially on the belt platen 26, the controller 8 determines that the remaining sheet exists in the belt platen 26. Moreover, when the remaining sheet nipped by at least one of the pairs of lower conveyance rollers 51 exists, the controller 8 determines that the remaining sheet exists in the lower conveyer 43.

When the controller 8 determines that the remaining sheets exist in both of the belt platen 26 and the lower conveyer 43 (step S4: YES), in step S5, the controller 8 determines whether the sheet size in the current print operation is the specified size or larger. In this case, the controller 8 can determine the sheet size in the current print operation from sheet size information included in the print job.

The specified size is set as a sheet size in which the remaining sheet is difficult to remove from the belt platen 26 while avoiding contact with the inkjet heads 36 with the belt platen 26 arranged at the intermediate position.

The work of removing the remaining sheet from the belt platen 26 needs to be performed in a space with a small width in the printer 1. In the state where the belt platen 26 is arranged at the intermediate position, the interval between the belt platen 26 and the inkjet heads 36 is relatively small, and the remaining sheet may thus come into contact with the inkjet heads 36 during the work.

Moreover, the larger the sheet size is, the larger the work space is which is required to remove the remaining sheet from the belt platen 26 without the remaining sheet coming into contact with the inkjet heads 36. Accordingly, in the state where the belt platen 26 is arranged at the intermediate position, it is difficult to remove the remaining sheet with a relatively large sheet size from the belt platen 26 without the remaining sheet coming into contact with the inkjet heads 36. Meanwhile, when the remaining sheet has a relatively small sheet size, the remaining sheet can be removed from the belt platen 26 without coming into contact with the inkjet heads 36 even when the work space is relatively small.

Hence, the specified size is set to determine whether the remaining sheet can be removed from the belt platen 26 while avoiding contact with the inkjet heads 36 with the belt platen arranged at the intermediate position.

When the controller 8 determines that the sheet size is the specified sheet size or larger (step S5: YES), in step S6, the controller 8 determines to initially position the belt platen 26 at the lower limit position for the jam removal, and moves the belt platen 26 from the print position to the lower limit position.

Next, instep S7, the controller 8 displays a jam removal screen on the display unit 71. The jam removal screen displayed herein is a screen for instructing the user to remove the remaining sheet in the belt platen 26. The user having checked the jam removal screen performs work of opening a front door (not illustrated) of the printer 1 and removing the remaining sheet from the belt platen 26.

Next, in step S8, the controller 8 determines whether the remaining sheet is removed from the belt platen 26. A method of determining whether the remaining sheet is removed from the belt platen 26 varies depending on the state of the remaining sheet in the belt platen 26. For example, in the case where the remaining sheet exists partially on the belt platen 26 and is detected by the sheet sensor 28, the controller 8 determines that the remaining sheet is removed from the belt platen 26 when the sheet sensor 28 changes to a non-detection state. When the controller 8 determines that the remaining sheet is not removed from the belt platen 26 (step S8: NO), the controller 8 repeats step S8.

When the controller 8 determines that the remaining sheet is removed from the belt platen 26 (step S8: YES), in step S9, the controller 8 moves the belt platen 26 from the lower limit position to the print position. In this case, the controller 8 moves the belt platen 26 from the lower limit position to the print position after the user closes the front door of the printer 1. Thereafter, the controller 8 proceeds to step S14.

When the controller 8 determines in step S5 that the sheet size is smaller than the specified size (step S5: NO), in step S10, the controller 8 moves the belt platen 26 from the lower limit position to the intermediate position. Thereafter, the controller 8 proceeds to step S14.

When the controller 8 determines in step S4 that no remaining sheet exists in at least one of the belt platen 26 and the lower conveyer 43 (step S4: NO), in step S11 of FIG. 6, the controller 8 determines whether the remaining sheet exists in the lower conveyer 43.

When the controller 8 determines that the remaining sheet exists in the lower conveyer 43 (step S11: YES), in step S12, the controller 8 maintains the belt platen 26 at the print position. Thereafter, the controller 8 proceeds to step S14 of FIG. 5.

When the controller 8 determines that no remaining sheet exists in the lower conveyer 43 (step S11: NO), in step S13, the controller 8 moves the belt platen 26 from the print position to the lower limit position. Thereafter, the controller 8 proceeds to step S14 of FIG. 5.

In step S14 of FIG. 5, the controller 8 displays the jam removal screen for instructing the user to remove the remaining sheet in the printer 1 on the display unit 71. The user having checked the jam removal screen performs the work of removing the remaining sheet from each of the units of the printer 1.

Next, in step S15, the controller 8 determines whether the sheet jam is cleared. When the controller 8 determines that all remaining sheets are removed based on sheet detection states of the sheet sensors 22 to 24, 28, 48, 53, 54, 65, and 66, the controller 8 determines that the sheet jam is cleared. When the controller 8 determines that the sheet jam is not cleared (step S15: NO), the controller 8 repeats step S15.

When the controller 8 determines that the sheet jam is cleared (step S15: YES), in step S16, the controller 8 resumes the print operation. Specifically, the controller 8 resumes the sheet conveyance by the sheet feeder 2, the belt platen conveyer 3, the circulation conveyers, and the sheet discharger 6 and performs printing by using the printing unit 4. After resuming the print operation, the controller 8 returns to step S2. In step S16, the controller 8 moves the belt platen 26 back to the print position prior to the sheet conveyance if the belt platen 26 is not located at the print position (in case of step S10 and S13).

When the controller 8 determines in step S2 that no sheet jam is occurring (step S2: NO), in step S17, the controller 8 determines whether sheet discharge of all printed sheets is completed based on the print job. When the controller 8 determines that the sheet discharge is not completed (step S17: NO), the controller 8 returns to step S2.

When the controller 8 determines that the sheet discharge is completed (step S17: YES), in step S18, the controller 8 terminates the sheet conveyance operation. The series of operations is thereby completed.

As described above, in the printer 1, when no remaining sheet exists in the lower conveyer 43, the controller 8 determines to position the belt platen 26 at the lower limit position for the jam removal. In this case, since the work of removing the remaining sheet from the lower conveyer 43 is unnecessary, the controller 8 disposes the belt platen 26 at the lower limit position. The work space for removing the remaining sheet is thereby formed when the remaining sheet exists in the belt platen 26.

Moreover, when the remaining sheet exists in the lower conveyer 43 and no remaining sheet exists in the belt platen 26, the controller 8 determines to position the belt platen 26 at the print position for the jam removal. In this case, since the work of removing the remaining sheet from the belt platen 26 is unnecessary, the controller 8 maintains the belt platen 26 at the print position. The work space for the user to remove the remaining sheet from the lower conveyer 43 by operating the lower jam removal mechanism 55 is thereby formed.

Furthermore, when the remaining sheets exist in both of the belt platen 26 and the lower conveyer 43 and the sheet size is smaller than the specified size, the controller 8 determines to position the belt platen 26 at the intermediate position for the jam removal. Disposing the belt platen 26 at the intermediate position forms the work space for removing the remaining sheet smaller than the specified size from the belt platen 26 and the work space for the user to remove the remaining sheet from the lower conveyer 43 by operating the lower jam removal mechanism 55.

The work spaces for removing the remaining sheets from the belt platen 26 and the lower conveyer 43 are thereby formed without moving the belt platen 26 in the middle of the jam removal work when the size of the remaining sheet is so small that only a relatively small work space is required to remove the remaining sheet from the belt platen 26. When the belt platen 26 is to be moved in the middle of the jam removal work, the user needs to close the front door of the printer 1 as described above. Accordingly, it is preferable not to move the belt platen 26 in the middle of the jam removal work.

Moreover, when the remaining sheets exist in both of the belt platen 26 and the lower conveyer 43 and the sheet size is the specified size or larger, the controller 8 determines to initially position the belt platen 26 at the lower limit position for the jam removal, and changes the position of the belt platen 26 to the print position after the remaining sheet is removed from the belt platen 26.

Since the belt platen 26 is thereby arranged at the lower limit position when the remaining sheet is removed from the belt platen 26, the work space for removing the remaining sheet of the specified size or larger from the belt platen 26 is formed. Moreover, since the belt platen 26 is arranged at the print position when the remaining sheet is removed from the lower conveyer 43, the work space for removing the remaining sheet from the lower conveyer 43 is formed. Hence, the work spaces for removing the remaining sheets from the belt platen 26 and the lower conveyer 43 are formed when the size of the remaining sheets is so large that a relatively large work space is required to remove the remaining sheets from the belt platen 26.

As described above, the frequency of moving of the belt platen 26 in the middle of the jam removal work is reduced by disposing the belt platen 26 at the intermediate position when the remaining sheets exist in both of the belt platen 26 and the lower conveyer 43, provided that the sheet size is smaller than the specified sheet size. Accordingly, in the printer 1, it is possible to form the work spaces for removing the remaining sheets from the belt platen 26 and the lower conveyer 43 while reducing the frequency of moving the belt platen 26 in the middle of the jam removal work. As a result, the printer 1 can improve the usability for the jam removal.

Note that, when the remaining sheets exist in both of the belt platen 26 and the lower conveyer 43 and the sheet size is the specified size or larger (step S5: YES), the controller 8 may perform the following operations: the controller 8 determines to initially position the belt platen 26 at the print position for the jam removal and maintains the belt platen 26 at the print position; after the remaining sheet is removed from the lower conveyer 43, the controller 8 changes the position of the belt platen 26 to the lower limit position and moves the belt platen 26 thereto.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printer comprising:

a print conveyer configured to convey a sheet during image formation;

an elevator configured to lift up and down the print conveyer to any of a print position for performing image formation, a lower limit position lower than the print position, and an intermediate position between the print position and the lower limit position;

a sheet feeder configured to feed the sheet to the print conveyer;

a sheet discharger configured to receive the sheet from the print conveyer and discharge the sheet;

a duplex printing conveyer including a lower conveyer configured to convey the sheet below the print conveyer, the duplex printing conveyer being configured to convey the sheet printed on one side from a downstream end to an upstream end of the print conveyer in duplex printing; and a controller configured to control the elevator, wherein the controller is configured to:

upon no remaining sheet existing in the lower conveyer upon occurrence of a sheet jam, determine to position the print conveyer at the lower limit position for jam removal and then drive the elevator to move the print conveyer to the lower limit position;

upon a remaining sheet existing in the lower conveyer and no remaining sheet existing in the print conveyer upon occurrence of the sheet jam, determine to position the print conveyer at the print position for jam removal and then control the elevator to maintain the print conveyer at the print position;

upon remaining sheets existing in both the print conveyer and the lower conveyer and a sheet size of the sheets being smaller than a specified size upon occurrence of the sheet jam, determine to position the print conveyer at the intermediate position for jam removal and then drive the elevator to move the print conveyer to the intermediate position; and upon remaining sheets existing in both the print conveyer and the lower conveyer and the sheet size of the sheets being equal to or larger than the specified size upon occurrence of the sheet jam, determine to position the print conveyer at the print position for jam removal, control the elevator to maintain the print conveyer at the print position, determine to position the print conveyer at the lower limit position in response to removal of the remaining sheet from the lower conveyer, and then drive the elevator to move the print conveyer from the print position to the lower limit position, or determine to position the print conveyer at the lower limit position for jam removal, drive the elevator to move the print conveyer from the print position to the lower limit position, determine to position the print conveyer at the print position in response to removal of the remaining sheet from the lower conveyer, and then drive the elevator to move the print conveyer from the lower limit position to the print position.

* * * * *